US010923262B2

(12) United States Patent
Park et al.

(10) Patent No.: US 10,923,262 B2
(45) Date of Patent: Feb. 16, 2021

(54) INDUCTOR

(71) Applicant: SAMSUNG ELECTRO-MECHANICS CO., LTD., Suwon-Si (KR)

(72) Inventors: Sang Soo Park, Suwon-Si (KR); Young Ghyu Ahn, Suwon-Si (KR); Hwi Dae Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 310 days.

(21) Appl. No.: 16/015,921

(22) Filed: Jun. 22, 2018

(65) Prior Publication Data

US 2019/0115134 A1 Apr. 18, 2019

(30) Foreign Application Priority Data

Oct. 18, 2017 (KR) ..... 10-2017-0135058

(51) Int. Cl.
*H01F 27/29* (2006.01)
*H01F 17/00* (2006.01)
*H01F 27/28* (2006.01)

(52) U.S. Cl.
CPC ..... *H01F 17/0013* (2013.01); *H01F 27/2804* (2013.01); *H01F 27/292* (2013.01); (Continued)

(58) Field of Classification Search
CPC ..... H01F 17/0013; H01F 27/2804; H01F 27/292; H01F 2017/0066; H01F 2027/2809; H01F 2017/002
See application file for complete search history.

(56) References Cited

U.S. PATENT DOCUMENTS

2008/0157913 A1 7/2008 Kim
2009/0322458 A1 12/2009 Lee et al.
(Continued)

FOREIGN PATENT DOCUMENTS

EP 1 085 538 A1 3/2001
JP 2001-085230 A 3/2001
(Continued)

OTHER PUBLICATIONS

Japanese Office Action dated Oct. 30, 2018 issued in Japanese Patent Application No. 2018-124694 (with English translation).
(Continued)

*Primary Examiner* — Tuyen T Nguyen
(74) *Attorney, Agent, or Firm* — Morgan, Lewis & Bockius LLP

(57) ABSTRACT

An inductor includes: a body having a stack of a plurality of insulating layers, each of which has a coil pattern disposed thereon; and first and second external electrodes disposed on an external surface of the body, wherein the plurality of coil patterns are connected to each other by a coil connection portion and form a coil having both end portions connected to the first and second external electrodes through a coil lead portion, and the plurality of coil patterns are composed of coil patterns disposed in outermost positions and coil patterns disposed inwardly of the coil patterns disposed in the outermost positions of the body, a thickness of at least one of the coil patterns disposed inwardly being thicker than that of the coil patterns disposed in the outermost positions.

18 Claims, 7 Drawing Sheets

(52) U.S. Cl.
CPC ..... *H01F 2017/002* (2013.01); *H01F 2017/0066* (2013.01); *H01F 2027/2809* (2013.01)

(56) References Cited

U.S. PATENT DOCUMENTS

| | | | | |
|---|---|---|---|---|
| 2011/0074535 | A1 | 3/2011 | Banno | |
| 2013/0214889 | A1* | 8/2013 | Kim | H01F 27/292 336/192 |
| 2015/0028988 | A1 | 1/2015 | Yamauchi et al. | |
| 2017/0103846 | A1 | 4/2017 | Yoneda | |
| 2017/0110236 | A1 | 4/2017 | Jang et al. | |

FOREIGN PATENT DOCUMENTS

| | | | |
|---|---|---|---|
| JP | 2001-217126 | A | 8/2001 |
| JP | 2004-014549 | A | 1/2004 |
| JP | 2012-160497 | A | 8/2012 |
| JP | 2015-026760 | A | 2/2015 |
| JP | 2016-139742 | A | 8/2016 |
| KR | 10-0869741 | B1 | 11/2008 |
| KR | 10-2010-0008600 | A | 1/2010 |
| KR | 10-2011-0035848 | A | 4/2011 |
| KR | 10-2017-0045629 | A | 4/2017 |
| TW | 201001457 | A | 1/2010 |
| WO | 2016/006542 | A1 | 1/2016 |

OTHER PUBLICATIONS

Office Action issued in corresponding Japanese Application No. 2018-124694, dated Jul. 9, 2019.
Korean Office Action dated Nov. 14, 2018 issued in Korean Patent Application No. 10-2017-0135058 (with English translation).
Office Action issued in corresponding Japanese Patent Application No. 2018-124694 dated May 19, 2020, with English translation.
Office Action issued in corresponding Chinese Patent Application No. 201811147889.0 dated Sep. 3, 2020, with English translation.

* cited by examiner

INDUCTOR

CROSS-REFERENCE TO RELATED APPLICATION(S)

This application claims the benefit of priority to Korean Patent Application No. 10-2017-0135058 filed on Oct. 18, 2017, in the Korean Intellectual Property Office, the disclosure of which is incorporated herein by reference in its entirety.

TECHNICAL FIELD

The present disclosure relates to an inductor.

BACKGROUND

In some recently released smartphones, signals in various frequency bands are used due to the application of multiband long term evolution (LTE). Therefore, a high-frequency inductor has mainly been used as an impedance matching circuit in a RF signal transceiver system. The high-frequency inductor should have a small size and high inductance. In addition, the high-frequency inductor should have a self resonance frequency (SRF) in a high frequency band and a low specific resistance, such that the high-frequency inductor should be able to be used at a high frequency of 100 MHz or more. Further, in order to decrease a loss in a used frequency, the high-frequency inductor should have a high Q factor.

Since characteristics of a material configuring a body of the inductor have the largest influence, the Q factor may be changed depending on a shape of a coil of the inductor, even in a case of using the same material, and, in order to have a high Q factor, there is a need to optimize the shape of the coil of the inductor to allow the inductor to have a higher Q factor.

SUMMARY

An aspect of the present disclosure may provide an inductor having a high Q factor.

According to an aspect of the present disclosure, an inductor may include: a body formed by stacking a plurality of insulating layers on which a coil pattern is disposed; and first and second external electrodes disposed on an external surface of the body, wherein the plurality of coil patterns are connected to each other by a coil connection portion and form a coil having both end portions connected to the first and second external electrodes through a coil lead portion, and the plurality of coil patterns are composed of coil patterns disposed in outermost positions and coil patterns disposed inwardly of the coil patterns disposed in the outermost positions of the body, a thickness of at least one of the coil patterns disposed inwardly being thicker than that of the coil patterns disposed in the outermost positions.

According to another aspect of the present disclosure, an inductor may include: a body formed by stacking a plurality of insulating layers on which a coil pattern is disposed, and first and second external electrodes disposed on an external surface of the body, wherein the plurality of coil patterns are composed of coil patterns disposed on outermost positions of the body and coil patterns disposed inwardly of the coil patterns disposed on the outermost positions, a cross-sectional area of at least one of the coil patterns disposed inwardly being larger than that of the coil patterns disposed in the outermost positions.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
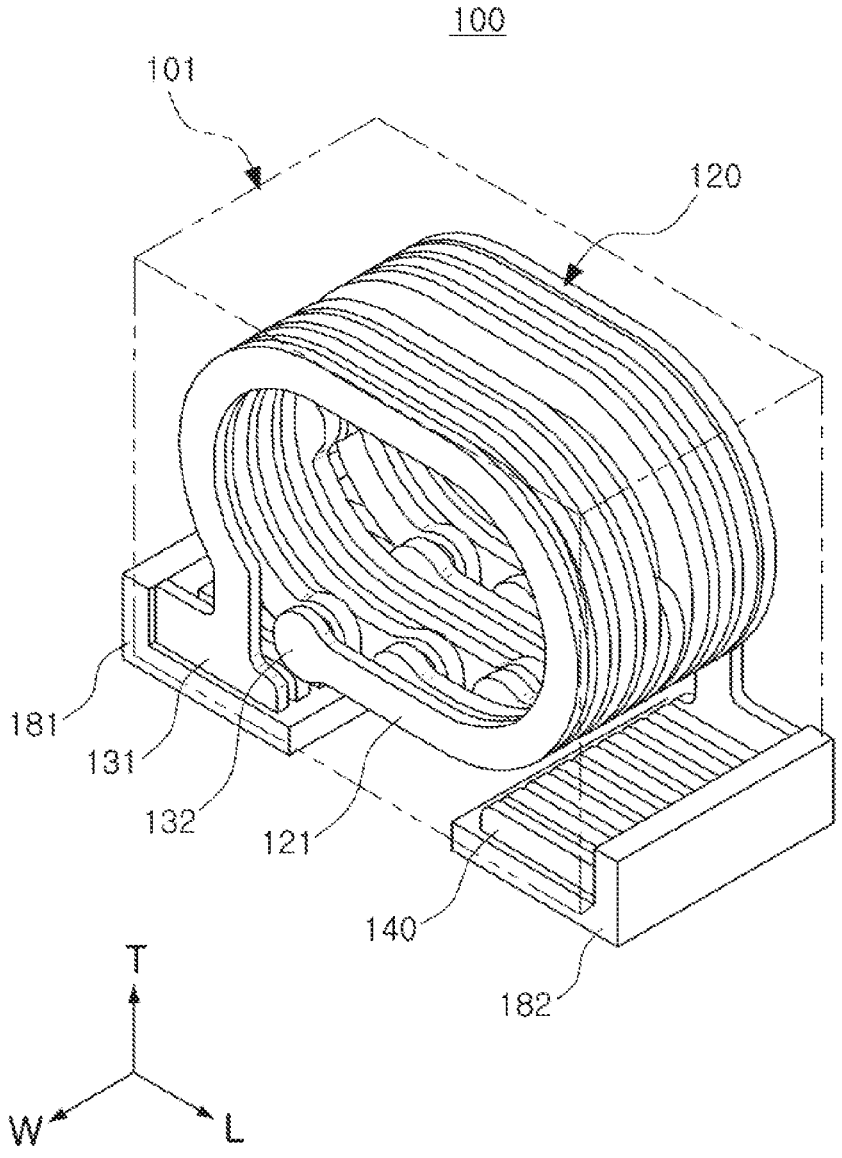
FIG. 1 is a schematic transparent perspective view of an inductor according to an exemplary embodiment in the present disclosure.

Hereinafter, exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

Hereinafter, W, L, and T illustrated in the accompanying drawings refer to a first direction, a second direction, and a third direction, respectively.

Figure 2:
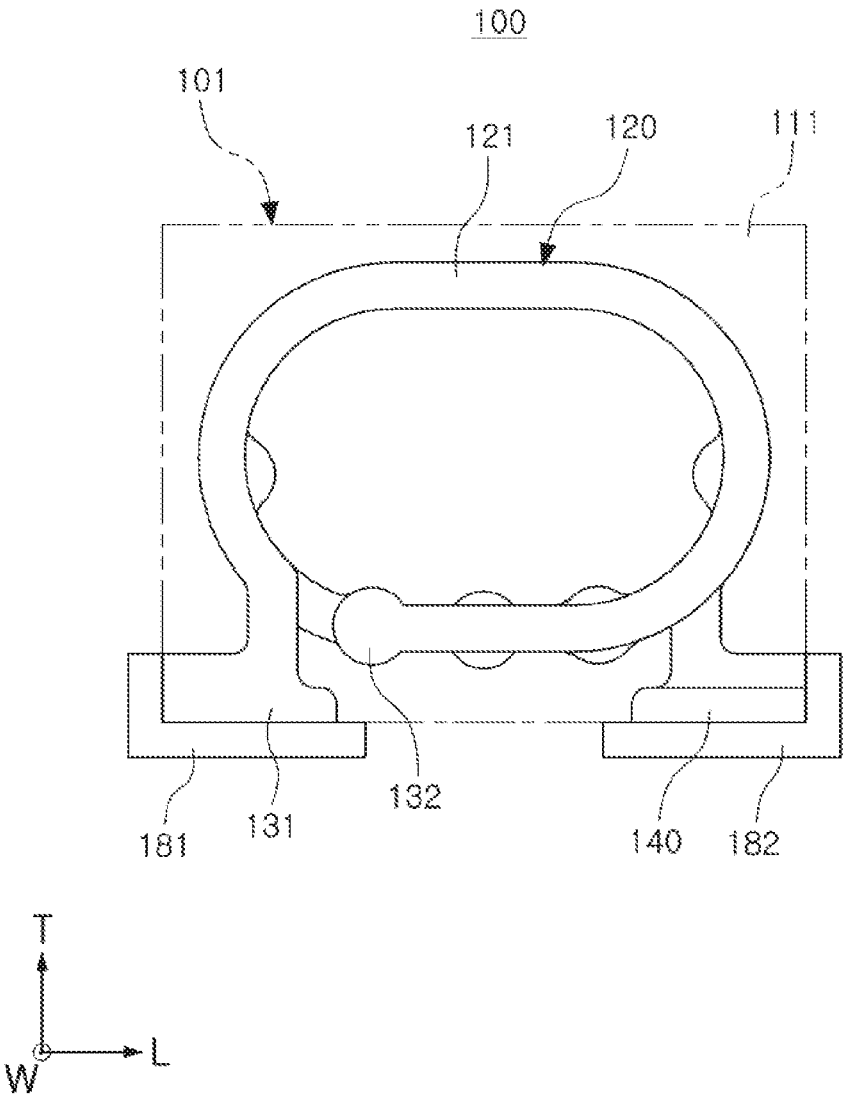
FIG. 2 is a schematic front view of the inductor of FIG. 1.
Figure 3:
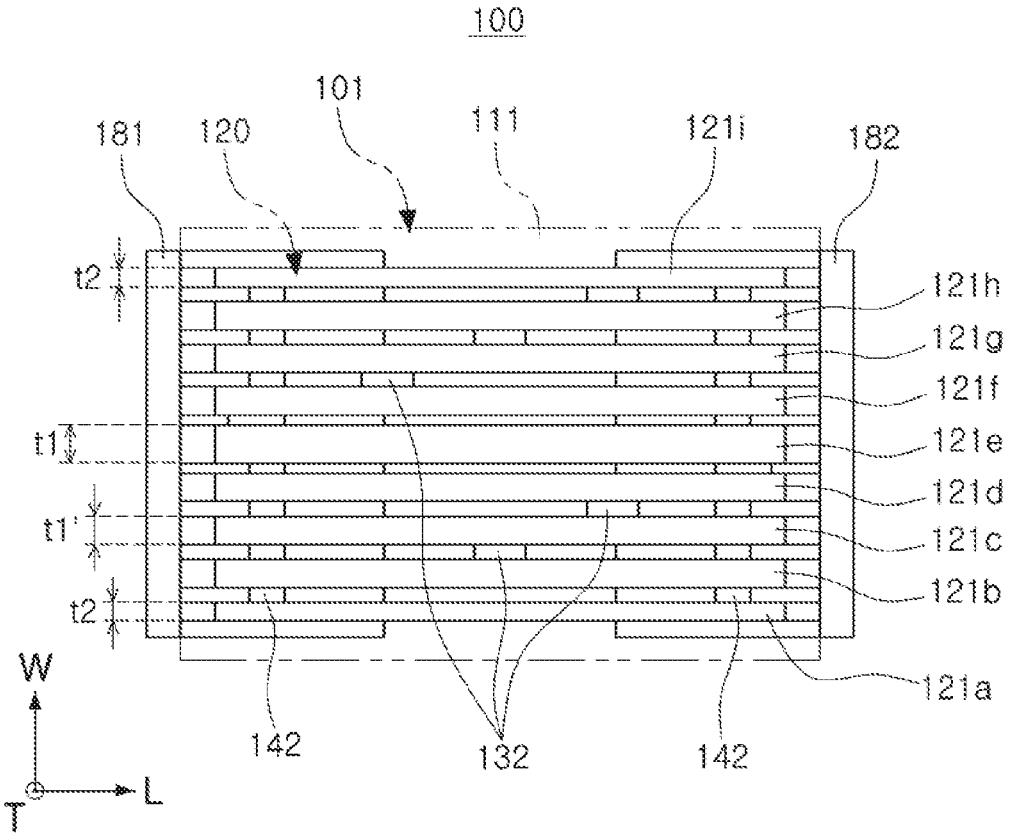
FIG. 3 is a schematic plan view of an inductor of FIG. 1 according to a first exemplary embodiment in the present disclosure.

FIG. 1 is a schematic transparent perspective view of an inductor 100 according to an exemplary embodiment in the present disclosure, FIG. 2 is a schematic front view of the inductor of FIG. 1, and FIG. 3 is a schematic plan view of an inductor of FIG. according to a first exemplary embodiment in the present disclosure.

A structure of the inductor 100 according to the first exemplary embodiment in the present disclosure will be described with reference to FIGS. 1 through 3.

A body 101 of the inductor 100 according to the first exemplary embodiment in the present disclosure may be formed by stacking a plurality of insulating layers 111 in the first direction horizontal to a mounting surface of the body 101.

The insulating layer 111 may be a magnetic layer or dielectric layer.

When the insulating layer 111 is a dielectric layer, the insulating layer 111 may contain a barium titanate ($BaTiO_3$) based ceramic powder. In this case, an example of the barium titanate ($BaTiO_3$) based ceramic powder may include $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, or the like, in which calcium (Ca), zirconium (Zr), or the like, is partially solid-dissolved in $BaTiO_3$. However, the example of the barium titanate ($BaTiO_3$) based ceramic powder is not limited thereto.

When the insulating layer 111 is a magnetic layer, the insulating layer 111 may be formed of a material suitably selected from materials capable of being used in a body of an inductor. For example, a resin, a ceramic, ferrite, or the like, may be used. In the present exemplary embodiment, the magnetic layer may be formed of a photosensitive insulating material, such that a fine pattern may be implemented through a photo-lithography method. That is, the magnetic layer is formed of the photosensitive insulating material, such that a coil pattern 121, a coil lead portion 131, and a coil connection portion 132 may be finely formed, thereby contributing to miniaturization and function improvement of the inductor 100. To this end, for example, a photosensitive organic material or photosensitive resin may be contained in the magnetic layer. An inorganic ingredient such as $SiO_2$/$Al_2O_3$/$BaSO_4$/talc, or the like, may be further contained in the magnetic layer as a filler ingredient in addition to the above-mentioned ingredient.

First and second external electrodes 181 and 182 may be disposed on an external surface of the body 101.

For example, the first and second external electrodes 181 and 182 may be disposed on the mounting surface of the body 101. The mounting surface of the body 101 may mean a surface of the body 101 facing a printed circuit board at the time of mounting the inductor on the printed circuit board.

The external electrodes 181 and 182 may serve to electrically connect the inductor 100 and the printed circuit board to each other at the time of mounting the inductor 100 on the printed circuit board (PCB). The external electrodes 181 and 182 may be disposed to be spaced apart from each other on edges of the body 101 in the first direction and the second direction horizontal to the mounting surface. The external electrodes 181 and 182 may include, for example, conductive resin layers, and conductor layers formed on the conductive resin layers, respectively, but are not limited thereto. The conductive resin layer may contain one or more conductive metals selected from the group consisting of copper (Cu), nickel (Ni), and silver (Ag), and a thermosetting resin. The conductor layer may contain one or more selected from the group consisting of nickel (Ni), copper (Cu), and tin (Sn). For example, a nickel (Ni) layer and a tin (Sn) layer may be sequentially formed in the conductor layer.

Referring to FIGS. 1 through 3, the coil pattern 121 may be formed on the insulating layer 111.

Adjacent coil patterns 121 may be electrically connected to each other by the coil connection portion 132. That is, spiral coil patterns 121 may be connected to each other by the coil connection portion 132, thereby forming a coil 120. Both end portions of the coil 120 may be connected to the first and second external electrodes 181 and 182 by the coil lead portion 131, respectively. The coil connection portion 132 may have a wide line width as compared to the coil pattern 121 in order to improve connectivity between the coil patterns 121, and include a conductive via penetrating through the insulating layer 111.

The coil lead portion 131 may be exposed to both end portions of the body 101 in the length direction and may also be exposed to a lower surface of the body 101, corresponding to a board mounting surface. Therefore, the coil lead portion 131 may have an L shape in a cross section of the body 101 in a length-thickness direction.

Referring to FIGS. 2 and 3, a dummy electrode 140 may be formed on portions of the insulating layer 111 corresponding to the external electrodes 181 and 182. The dummy electrode 140 may serve to improve close adhesion between the external electrodes 181 and 182 and the body 101 or serve as a bridge when the external electrodes are formed by plating.

Further, the dummy electrode 140 and the coil lead portion 131 may be connected to each other by a via electrode 142.

The coil pattern 121, the coil lead portion 131, and the coil connection portion 132 may be formed of a conductive material such as copper (Cu), aluminum (Al), silver (Ag), tin (Sn), gold (Au), nickel (Ni), lead (Pb), which are metals having excellent conductivity, an alloy thereof, or the like. The coil pattern 121, the coil lead portion 131, and the coil connection portion 132 may be formed by a plating method or printing method, but are not limited thereto.

Since the inductor 100 according to the first exemplary embodiment in the present disclosure is manufactured by forming the coil pattern 121, the coil lead portion 131, the coil connection portion 132, or the like, on the insulating layer 111 and then stacking the insulating layer 111 in the first direction horizontal to the mounting surface, the inductor 100 may be more easily manufactured as compared to the related art. Further, the coil pattern 121 may be disposed to be perpendicular to the mounting surface, thereby preventing a magnetic flux from being affected by a mounting board.

Referring to FIGS. 2 and 3, at the time of projecting the coil 120 of the inductor 100 according to the first exemplary embodiment in the present disclosure in the first direction, the coil patterns 121 may overlap each other to form a coil track with 1 or more coil turns.

More specifically, the first external electrode 181 and a first coil pattern 121*a* may be connected to each other by the coil lead portion 131, and sequentially, first to ninth coil patterns 121*a* to 121*i* may be connected to each other by the coil connection portion 132. Finally, the ninth coil pattern 121*i* may be connected to the second external electrode 181 by the coil lead portion 131, such that the coil 120 may be formed.

Referring to FIG. 3, in the inductor 100 according to the exemplary embodiment in the present disclosure, the plurality of coil patterns 121 may be composed of coil patterns 121*a* and 121*i* disposed in outermost positions of the body 101 and coil patterns 121*b* to 121*h* disposed inwardly of the coil patterns 121*a* and 121*i*, and at least one of the coil patterns 121*b* to 121*h* disposed inwardly may be formed to have a thickness thicker than that of the coil patterns 121*a* and 121*i* disposed in the outermost positions.

The coil patterns 121*a* and 121*i* disposed in the outermost positions mean coil patterns disposed to be adjacent to both side surfaces of the body 101 in a stacking direction of the plurality of coil patterns 121, that is, the width direction of the body 101.

In other words, the coil patterns 121*a* and 121*i* disposed in the outermost positions may mean that there is no adjacent coil pattern in directions toward the both side surfaces of the body 101, but adjacent coil patterns are present only in direction towards the inner portion, respectively.

The coil patterns 121*b* to 121*h* disposed inwardly may mean a plurality of coil patterns between outermost coil patterns 121*a* and 121*i* disposed to be adjacent to both side surfaces of the body 101 in the width direction.

Further, the coil patterns 121*b* to 121*h* disposed inwardly may mean that the coil patterns 121*b* to 121*h* have coil patterns disposed to be adjacent to both sides thereof.

In an inductor according to the related art, a coil pattern is formed to have a constant thickness regardless of a position of the coil pattern.

In a case in which the coil pattern is formed to have a constant thickness regardless of the position of the coil pattern as in the related art, there is a difference in a current flow depending on the position due to a skin effect and a parasitic effect caused by an increase in AC frequency.

When there is a difference in the current flow depending on the position, a resistance value of the coil pattern may become non-uniform depending on the position.

A Q factor may be deteriorated due to non-uniformity of the resistance value.

More specifically, since the thickness of the coil pattern is constantly formed regardless of the position in the inductor according to the related art, a large amount of current flows to edge portions of coil patterns disposed in outermost positions due to the parasitic effect and the skin effect, such that a flow of the current may be concentrated toward the outside.

This phenomenon is caused by repulsive force occurring between two conducting wires in which a current flows in the same direction as each other.

Therefore, in the inductor according to the related art, the current may not uniformly flow in the entire coil pattern.

That is, a current passing area of the coil patterns disposed inwardly may be small as compared to the coil patterns disposed in the outermost positions.

As described above, since the current passing area is decreased in the coil pattern disposed inwardly, resistance depending on the flow of the current may be increased in the coil pattern disposed inwardly, which may act as a cause of decreasing the Q factor.

That is, resistance of the coil patterns disposed inwardly is larger than that of the coil patterns disposed in the outermost positions.

As described above, there is a need to allow resistances of the coil patterns depending on the position to be uniform by solving the problem that the flow of the current is non-uniform and thus the resistance value is non-uniform depending on the position of the coil pattern.

In a case of allowing the resistance of the coil pattern depending on the position to be uniform, the Q factor may be improved.

In the inductor according to the exemplary embodiment in the present disclosure, at least one of the coil patterns 121*b* to 121*h* disposed inwardly may be formed to have a thickness thicker than that of the coil patterns 121*a* and 121*i* disposed in the outermost positions.

In the inductor according to the exemplary embodiment in the present disclosure, at least one of the coil patterns 121*b* to 121*h* disposed inwardly may be formed to have a thickness thicker than that of the coil patterns 121*a* and 121*i* disposed in the outermost positions, such that a resistance value of at least one of the coil patterns 121*b* to 121*h* disposed inwardly may be decreased, and the Q factor may be improved.

In other words, resistance values of the coil patterns 121*b* to 121*h* disposed inwardly and the coil patterns 121*a* and 121*i* disposed in the outermost positions may be adjusted to be uniform, and as a result, the Q factor may be improved.

According to the exemplary embodiment in the present disclosure, in order to improve the Q factor, the resistance value of the coil pattern depending on the position may be adjusted to be uniform.

Further, according to the exemplary embodiment in the present disclosure, in order to adjust the resistance value of the coil pattern depending on the position to be uniform, the coil patterns 121*b* to 121*h* disposed inwardly and the coil patterns 121*a* and 121*i* disposed in the outermost positions may be adjusted to have different thicknesses from each other. Particularly, the coil patterns 121*b* to 121*h* disposed inwardly may be formed to have a thickness thicker than that of the coil patterns 121*a* and 121*i* disposed in the outermost positions.

According to the exemplary embodiment in the present disclosure, a method of adjusting the thicknesses of the coil patterns to have a uniform resistance value may be variously performed, and is not particularly limited.

For example, as in the first exemplary embodiment in the present disclosure, at least one of the coil patterns 121*b* to 121*h* disposed inwardly may be formed to have a thickness thicker than that of the coil patterns 121*a* and 121*i* disposed in the outermost positions.

That is, as illustrated in FIG. 3, a thickness t1 of at least one coil pattern 121*e* of the coil patterns 121*b* to 121*h* disposed inwardly may be formed to have a thickness thicker than the thickness t2 of the coil patterns 121*a* and 121*i* disposed in the outermost positions.

Further, the thickness t1 of at least one coil pattern 121*e* of the coil patterns 121*b* to 121*h* disposed inwardly may be different from a thickness t1' of the other coil patterns 121*b* to 121*d* and 121*f* to 121*h* disposed inwardly.

However, the thickness t1 of at least one coil pattern 121*e* of the coil patterns 121*b* to 121*h* disposed inwardly is not limited thereto, but may be equal to the thickness t1' of the other coil patterns 121*b* to 121*d* and 121*f* to 121*h* disposed inwardly.

In another example, all of the coil patterns 121*b* to 121*h* disposed inwardly may be formed to have thicknesses thicker than that of the coil patterns 121*a* and 121*i* disposed in the outermost positions. In this case, thicknesses of the coil patterns 121*b* to 121*h* disposed inwardly may be equal to or different from each other.

Meanwhile, as the coil patterns 121*a* and 121*i* disposed in outmost portions, one coil pattern 121*a* and one coil pattern 121*i*, that is, a total of two coil patterns, may be disposed in both sides, respectively. Here, the outermost coil patterns 121*a* and 121*i* may have the same thickness as each other or different thicknesses from each other.

Various exemplary embodiments described above will be described in more detail with reference to the accompanying drawings.

When a thickness of a coil pattern having a thickness thicker than that of the coil patterns disposed in the outermost positions among the coil patterns 121*b* to 121*h* disposed inwardly is defined as t1 and the thickness of the coil patterns 121*a* and 121*i* disposed in the outermost positions is defined as t2, a ratio (t1/t2) of the thickness t1 of the coil pattern thicker than the coil patterns disposed in the outermost position among the coil patterns 121*b* to 121*h* disposed inwardly to the thickness t2 of the coil patterns 121*a* and 121*i* disposed in the outermost positions may satisfy $1<(t1/t2)<12.6$.

The resistance value of the coil pattern depending on the position may be adjusted to be uniform by adjusting the ratio (t1/t2) of the thickness t1 of the coil pattern thicker than the coil patterns disposed in the outermost position among the coil patterns 121*b* to 121*h* disposed inwardly to the thickness t2 of the coil patterns 121*a* and 121*i* disposed in the outermost positions to satisfy $1<(t1/t2)<12.6$, such that the Q factor may be improved.

When the ratio (t1/t2) of the thickness t1 of the coil pattern thicker than the coil patterns disposed in the outermost position among the coil patterns 121*b* to 121*h* disposed inwardly to the thickness t2 of the coil patterns 121*a* and 121*i* disposed in the outermost positions is more than 12.6, it is impossible to improve the Q factor.

Figure 4:
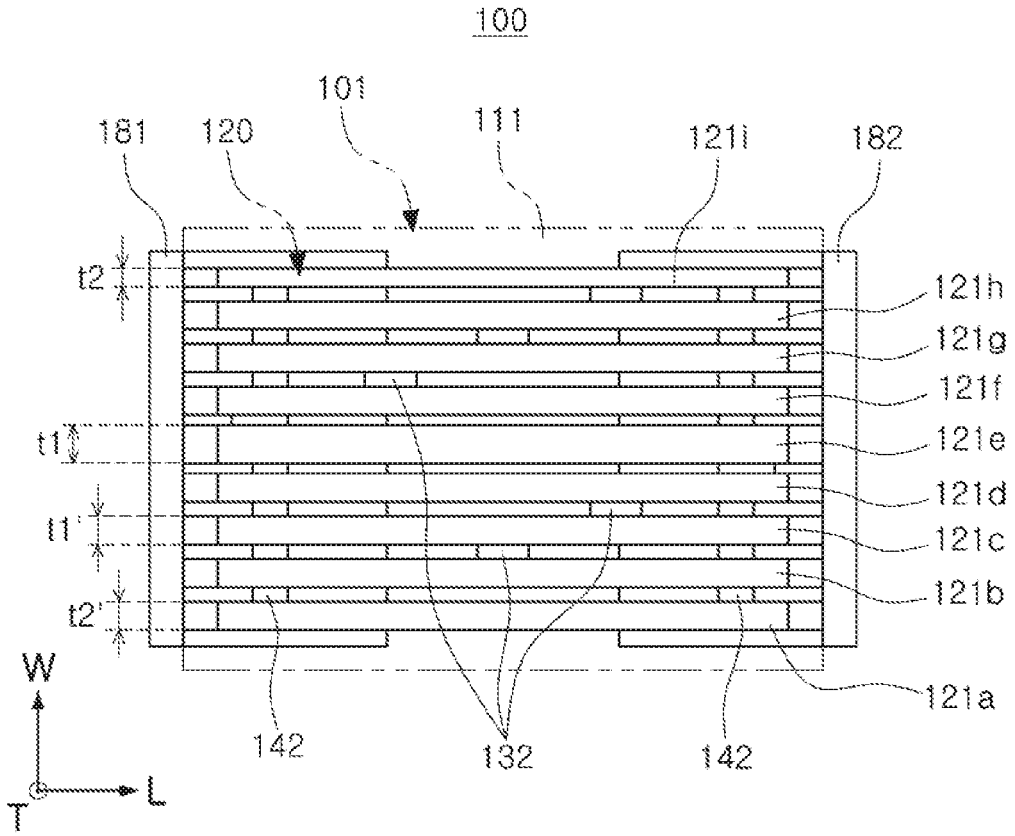
FIG. 4 is a schematic plan view of an inductor of FIG. 1 according to a second exemplary embodiment in the present disclosure.

FIG. 4 is a schematic plan view of an inductor of FIG. 1 according to a second exemplary embodiment.

Referring to FIG. 4, in the inductor according to the second exemplary embodiment, as coil patterns 121*a* and 121*i* disposed in outmost portions, one coil pattern 121*a* and one coil pattern 121*i*, that is, a total of two coil patterns, may be disposed in both sides, respectively. Here, the outermost coil patterns 121*a* and 121*i* may have different thicknesses from each other.

That is, a thickness t2' of one coil pattern 121*a* of the outermost coil patterns and a thickness t2 of the other coil pattern 121*i* may be different from each other. In this case, t2 may be greater or smaller than t2' but is not particularly limited thereto.

Figure 5:
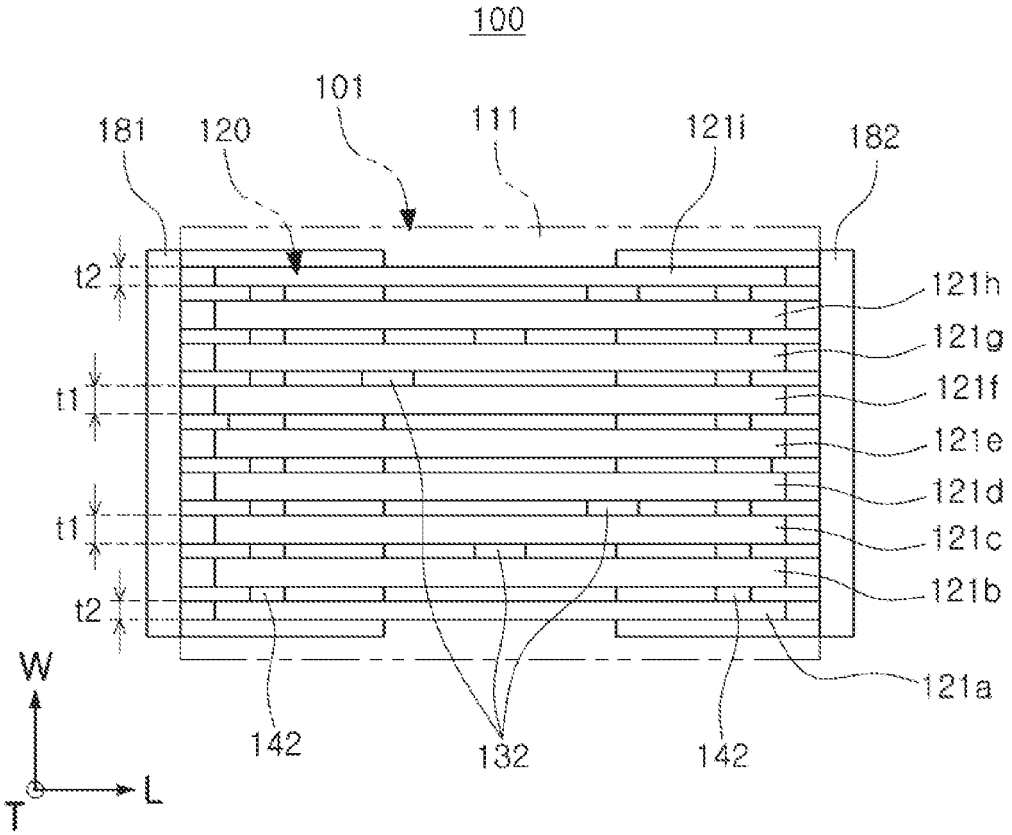
FIG. 5 is a schematic plan view of an inductor of FIG. 1 according to a third exemplary embodiment in the present disclosure.

FIG. 5 is a schematic plan view of an inductor of FIG. 1 according to a third exemplary embodiment.

Referring to FIG. 5, in the inductor according to the third exemplary embodiment, a thickness t1 of the entire coil patterns 121*b* to 121*h* disposed inwardly may be thicker than a thickness t2 of coil patterns 121*a* and 121*i* disposed in outermost positions. In this case, the entire coil patterns 121*b* to 121*h* disposed inwardly may have the same thickness t1 as each other.

Further, the thickness of the coil patterns 121*a* and 121*i* disposed in outermost positions may be thinner than the thickness of the coil patterns 121*b* to 121*h* disposed inwardly. In this case, the outermost coil patterns 121*a* and 121*i* may have the same thickness t2 as each other.

Figure 6:
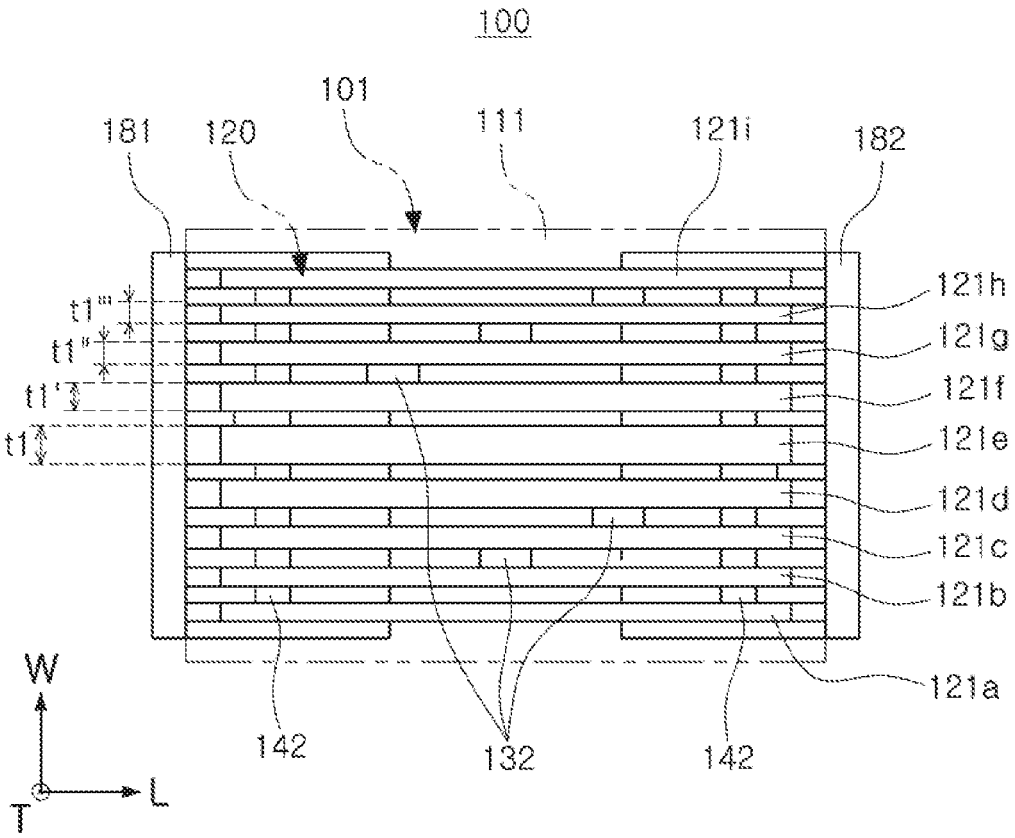
FIG. 6 is a schematic plan view of an inductor of FIG. 1 according to a fourth exemplary embodiment in the present disclosure.

FIG. 6 is a schematic plan view of an inductor of FIG. 1 according to a fourth exemplary embodiment.

Referring to FIG. 6, in the inductor according to the fourth exemplary embodiment, thicknesses t1, t', t1", and t1'" of the entire coil patterns 121*b* to 121*h* disposed inwardly may be thicker than a thickness t2 of coil patterns 121*a* and 121*i* disposed in outermost positions. In this case, the coil patterns 121*b* to 121*h* disposed inwardly may be formed to have a thickness increased from the outermost position to a central portion.

Further, the coil patterns 121*a* and 121*i* disposed in the outermost positions may have the same thickness as each other or different thicknesses from each other.

According to the fourth exemplary embodiment, the coil patterns 121*b* to 121*h* disposed inwardly may be formed to have a thickness increased from the outermost position to a central portion, such that distribution of a resistance value of the coil pattern depending on the position may be more uniformly adjusted.

That is, a large amount of current flows to edge portions of coil patterns disposed in outermost positions due to a skin effect and a parasitic effect caused by an increase in AC frequency, such that a flow of the current may be concentrated toward the outside.

Therefore, the coil patterns 121*b* to 121*h* disposed inwardly may be formed to have a thickness increased from the outermost position to a central portion, such that the resistance value may be uniformly adjusted.

Although a case in which the number of stacked coil pattern layers is 9 is described in the first to fourth exemplary embodiments in the present disclosure, the number of stacked coil pattern layers is not necessarily limited thereto, but may be variously changed depending on a design.

Figure 7:
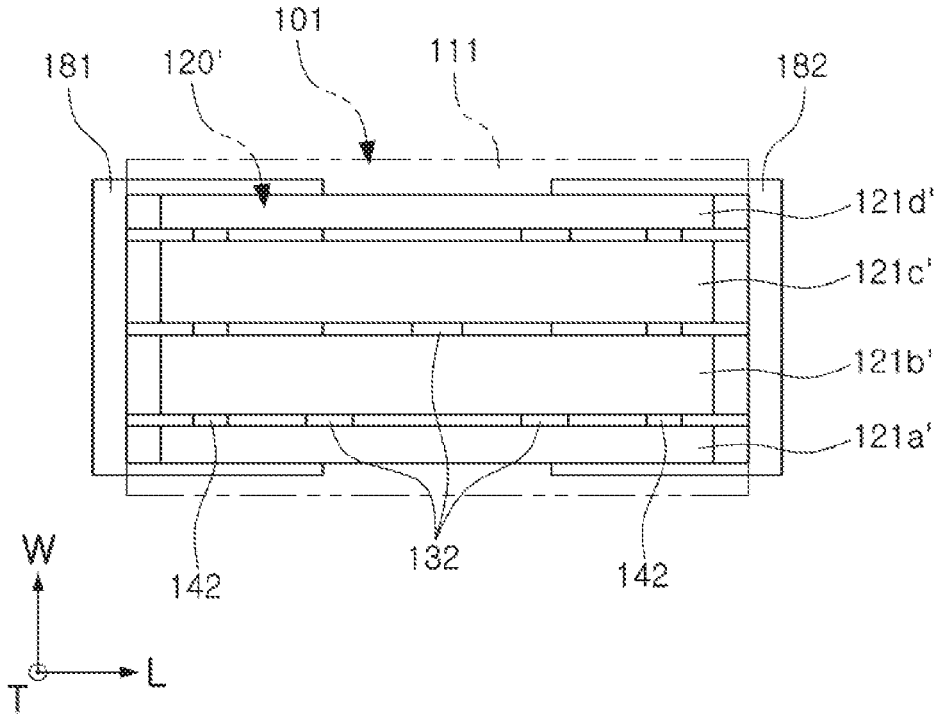
FIG. 7 is a schematic plan view of an inductor according to a fifth exemplary embodiment in the present disclosure.

FIG. 7 is a schematic plan view of an inductor according to a fifth exemplary embodiment.

Referring to FIG. 7, at the time of projecting a coil 120' of the inductor according to the fifth exemplary embodiment in a first direction, coil patterns 121*a*' to 121*d*' may overlap each other, thereby forming a coil track with one or more coil turns.

More specifically, in the inductor according to the fifth exemplary embodiment in the present disclosure, the plurality of coil patterns may be composed of coil patterns 121*a*' and 121*d*' disposed in outermost positions and coil patterns 121*b*' and 121*c*' disposed inwardly of the coil patterns 121*a*' and 121*d*', and at least one of the coil patterns 121*b*' and 121*c*' disposed inwardly may be formed to have a thickness thicker than that of the coil patterns 121*a*' and 121*d*' disposed in the outermost positions.

The coil patterns 121*a*' and 121*d*' disposed in outermost positions and the coil patterns 121*b*' and 121*c*' disposed inwardly thereof may be connected to each other by a coil connection portion 123, thereby forming the coil 120'.

Although a case in which the number of stacked coil pattern layers is 4 is described in the fifth exemplary embodiment in the present disclosure, the number of stacked coil pattern layers is not limited thereto, but may be variously changed.

An inductor 100 according to another exemplary embodiment in the present disclosure may include a body 101 formed by stacking a plurality of insulating layers 111 on which a coil pattern 121 is disposed, and first and second external electrodes 181 and 182 disposed on an external surface of the body 101, wherein the plurality of coil patterns 121 are composed of coil patterns disposed on outermost positions of the body 101 and coil patterns disposed inwardly of the coil patterns disposed on the outermost positions, a cross-sectional area of at least one of the coil patterns disposed inwardly being larger than that of the coil patterns disposed in the outermost positions.

According to another exemplary embodiment in the present disclosure, in order to improve a Q factor, the cross-sectional area of the coil patterns disposed inwardly and the cross-sectional area of the coil patterns disposed in the outermost positions may be adjusted to be different from each other. Particularly, the coil pattern disposed inwardly may be formed to have a cross-sectional area larger than that of the coil pattern disposed in the outermost position.

For example, the coil patterns disposed inwardly may be formed to have a cross-sectional area larger than that of the coil patterns disposed in the outermost positions, but the cross-sectional areas of the coil patterns disposed in the outermost positions may be different from or equal to each other.

In another example, the coil patterns disposed inwardly may be formed to have a cross-sectional area larger than that of the coil patterns disposed in the outermost positions, but the cross-sectional areas of the coil patterns disposed inwardly may be different from or equal to each other. However, the cross-sectional areas of the coil patterns disposed inwardly are not particularly limited thereto.

The following Table 1 illustrates results obtained by comparing Q factors of high-frequency inductors according to various Inventive Examples in the present disclosure.

Samples 2 to 10 indicate cases in which coil patterns disposed inwardly were formed to have a thickness thicker than that of coil patterns disposed in outermost positions, but the coil patterns disposed in the outermost positions had the same thickness as each other, and the coil patterns disposed inwardly had the same thickness as each other.

Samples 11 to 13 indicate cases in which coil patterns disposed inwardly were formed to have a thickness thicker than that of coil patterns disposed in outermost positions, but the coil patterns disposed inwardly had different thicknesses from each other.

Sample 14 indicates a case in which coil patterns disposed inwardly were formed to have a thickness thicker than that of coil patterns disposed in outermost positions, but one of the coil patterns disposed inwardly was formed to have a thickness thinner than that of the coil patterns disposed in the outermost positions.

Sample 15 indicates a case in which coil patterns disposed inwardly were formed to have a thickness thicker than that of coil patterns disposed in outermost positions, but the coil patterns disposed in the outermost positions had the same thickness as each other, and a thickness of one of the coil patterns disposed inwardly was different from a thickness of the other coil patterns disposed inwardly.

Sample 16 indicates a case in which coil patterns disposed inwardly were formed to have a thickness thicker than that of coil patterns disposed in outermost positions, but the coil patterns disposed in the outermost positions had different thicknesses from each other, and the coil patterns disposed inwardly had different thicknesses from each other.

Sample 17 indicates a case in which only one of coil patterns disposed inwardly had a thickness thicker than that of coil patterns disposed in outermost positions.

Sample 18 indicates a case in which only some of coil patterns disposed inwardly had a thickness thicker than that of coil patterns disposed in outermost positions.

TABLE 1

| Sample | OUT_1 | OUT_2 | IN_A | IN_B | IN_C | IN_D | IN_E | IN_F | IN_G | Q |
|---|---|---|---|---|---|---|---|---|---|---|
| *1 | 12.0 | 12.0 | 12.0 | 12.0 | 12.0 | 12.0 | 12.0 | 12.0 | 12.0 | 40.9 |
| 2 | 10.0 | 10.0 | 12.5 | 12.5 | 12.5 | 12.5 | 12.5 | 12.5 | 12.5 | 41.8 |
| 3 | 8.1 | 8.1 | 13.1 | 13.1 | 13.1 | 13.1 | 13.1 | 13.1 | 13.1 | 43.0 |
| 4 | 5.0 | 5.0 | 14.0 | 14.0 | 14.0 | 14.0 | 14.0 | 14.0 | 14.0 | 44.9 |
| 5 | 4.0 | 4.0 | 14.0 | 14.0 | 14.0 | 14.0 | 14.0 | 14.0 | 14.0 | 44.0 |
| 6 | 3.0 | 3.0 | 14.5 | 14.5 | 14.5 | 14.5 | 14.5 | 14.5 | 14.5 | 43.7 |
| 7 | 1.5 | 1.5 | 15.0 | 15.0 | 15.0 | 15.0 | 15.0 | 15.0 | 15.0 | 43.4 |
| 8 | 1.4 | 1.4 | 15.0 | 15.0 | 15.0 | 15.0 | 15.0 | 15.0 | 15.0 | 41.6 |
| 9 | 1.3 | 1.3 | 15.1 | 15.1 | 15.1 | 15.1 | 15.1 | 15.1 | 15.1 | 41.3 |
| *10 | 1.2 | 1.2 | 15.1 | 15.1 | 15.1 | 15.1 | 15.1 | 15.1 | 15.1 | 40.9 |
| 11 | 3.0 | 3.0 | 12.0 | 12.0 | 12.0 | 30.0 | 12.0 | 12.0 | 12.0 | 43.1 |
| 12 | 2.0 | 2.0 | 14.0 | 14.0 | 14.0 | 20.0 | 14.0 | 14.0 | 14.0 | 42.3 |
| 13 | 2.0 | 2.0 | 13.0 | 13.0 | 13.0 | 26.0 | 13.0 | 13.0 | 13.0 | 43.4 |
| 14 | 5.0 | 5.0 | 4.0 | 16.0 | 16.0 | 16.0 | 16.0 | 15.0 | 15.0 | 42.9 |
| 15 | 5.0 | 5.0 | 8.0 | 15.0 | 15.0 | 15.0 | 15.0 | 15.0 | 15.0 | 44.0 |
| 16 | 5.0 | 12.0 | 12.0 | 12.0 | 12.0 | 13.0 | 14.0 | 14.0 | 14.0 | 42.4 |
| 17 | 11.5 | 11.5 | 11.5 | 11.5 | 11.5 | 16.0 | 11.5 | 11.5 | 11.5 | 41.4 |
| 18 | 11.0 | 11.0 | 11.0 | 11.0 | 14.0 | 14.0 | 14.0 | 11.0 | 11.0 | 41.8 |

After manufacturing each of the high-frequency inductor samples in the following Table 1 so that the number of coil pattern layers stacked in a body was 9, each of the high-frequency inductor samples were evaluated.

In the following Table 1, sample 1, which is a case in which thicknesses of coil patterns disposed in outermost position and thicknesses of coil patterns disposed inwardly were entirely the same as each other, corresponds to Comparative Example indicating a structure of an inductor according to the related art.

In sample 1 of Table 1 in which the thicknesses of the coil patterns disposed in the outermost position and the thicknesses of the coil patterns disposed inwardly were entirely the same as each other, which corresponds to Comparative Example indicating the structure of the inductor according to the related art, Q factor was measured to 40.9.

Based on the Q factor of sample 1 corresponding to Comparative Example in the present disclosure, Q factors of samples according to various Inventive Examples in the present disclosure may be confirmed through Table 1.

More specifically, in samples 2 to 9 and 11 to 18 except for sample 10 among Inventive Examples in the present disclosure, it may be appreciated that when one or more of the coil patterns disposed inwardly had a thickness thicker than that of the coil patterns disposed in the outermost positions, the Q factor was improved.

Particularly, it may be appreciated that even in sample 17 in which only one of the coil patterns disposed inwardly had a thickness thicker than that of the coil patterns disposed in the outermost positions, the Q factor was improved as compared to the inductor according to the related art in which the coil patterns had the same thickness as each other.

Further, as a result of investigation based on sample 14, it may be appreciated that when most of the coil patterns disposed inwardly were formed to have a thickness thicker than that of the coil patterns disposed in the outermost positions, even though one of the coil patterns disposed inwardly was formed to have a thickness thinner than that of the coil patterns disposed in the outermost positions, the Q factor was improved.

In addition, it may be appreciated that when at least one of coil patterns disposed inwardly was formed to have a thickness thicker than that of the coil patterns disposed in the outermost positions, in a case in which the thicknesses of the coil patterns disposed inwardly were the same as or different from each other, the Q factor was improved.

Similarly, it may be appreciated that even though the thicknesses of the coil patterns disposed in the outermost positions were the same as or different from each other, the Q factor was improved.

Meanwhile, in sample 10, the Q factor was measured to be 40.9, which is equal to the Q factor measured in sample 1 corresponding to Comparative Example in the present disclosure. Therefore, it may be appreciated that an effect of improving the Q factor may be insufficient depending on a ratio between the thickness of the coil patterns disposed inwardly and the thickness of the coil patterns disposed in the outermost positions.

More specifically, it may be appreciated that when a ratio ($t1/t2$) of a thickness $t1$ of a coil pattern thicker than the coil patterns disposed in the outermost positions among the coil patterns disposed inwardly to the thickness $t2$ of the coil pattern disposed in the outermost positions was 12.6 or more as in sample 10, it was impossible to improve the Q factor.

On the contrary, it may be appreciated that in samples 2 to 9 and 11 to 18 in which a ratio ($t1/t2$) of a thickness $t1$ of a coil pattern thicker than the coil patterns disposed in the outermost positions among the coil patterns disposed inwardly to the thickness $t2$ of the coil pattern disposed in the outermost positions satisfied $1<(t1/t2)<12.6$, a resistance value of the coil pattern depending on the position may be adjusted to be uniform, such that the Q factor may be improved.

As set forth above, according to exemplary embodiments in the present disclosure, in the inductor, the plurality of coil patterns may be composed of the coil patterns disposed in the outermost positions of the body and the coil patterns disposed inwardly of the coil patterns disposed in the outermost positions, and at least one of the coil patterns disposed inwardly may be disposed to have a thickness thicker than that of the coil pattern disposed in the outermost positions, such that the Q factor of the inductor may be improved.

While exemplary embodiments have been shown and described above, it will be apparent to those skilled in the art that modifications and variations could be made without departing from the scope of the present invention as defined by the appended claims.

What is claimed is:

1. An inductor comprising:

a body having a stack of a plurality of insulating layers, each of which has a coil pattern disposed thereon;

first and second external electrodes disposed on an external surface of the body; and dummy electrodes formed on portions of the insulating layers corresponding to the first and second external electrodes, the dummy electrodes not being physically connected to the coil pattern disposed on corresponding insulating layers, wherein the plurality of coil patterns are connected to each other by a coil connection portion and form a coil having both end portions connected to the first and second external electrodes through a coil lead portion, the dummy electrodes are connected to each other by vias, and the plurality of coil patterns are composed of coil patterns disposed in outermost positions and coil patterns disposed inwardly of the coil patterns disposed in the outermost positions of the body, a thickness of at least one of the coil patterns disposed inwardly being thicker than that of the coil patterns disposed in the outermost positions.

2. The inductor of claim 1, wherein a ratio ($t1/t2$) of the thickness $t1$ of the coil pattern thicker than the coil patterns disposed in the outermost positions among the coil patterns disposed inwardly to the thickness $t2$ of the coil patterns disposed in the outermost positions satisfies $1<(t1/t2)<12.6$.

3. The inductor of claim 1, wherein the coil patterns disposed in the outermost positions have different thicknesses from each other.

4. The inductor of claim 1, wherein the plurality of coil patterns are stacked perpendicularly to a mounting surface.

5. The inductor of claim 1, wherein the coil patterns disposed inwardly have the same thickness as each other.

6. The inductor of claim 1, wherein the coil patterns disposed inwardly have different thicknesses from each other.

7. The inductor of claim 1, wherein the coil patterns disposed inwardly have a thickness increased from the outermost position of the body to a central portion of the body.

8. An inductor comprising:

a body having a stack of a plurality of insulating layers, each of which has a coil pattern disposed thereon;

first and second external electrodes disposed on an external surface of the body; and dummy electrodes formed on portions of the insulating layers corresponding to the first and second external electrodes, the dummy electrodes not being physically connected to the coil pattern disposed on corresponding insulating layers, wherein the plurality of coil patterns are composed of coil patterns disposed on outermost positions of the body and coil patterns disposed inwardly of the coil patterns disposed on the outermost positions, the dummy electrodes are connected to each other by vias, and a cross-sectional area of at least one of the coil patterns disposed inwardly is larger than that of the coil patterns disposed in the outermost positions.

9. The inductor of claim 8, wherein the coil patterns disposed in the outermost positions have different cross-sectional areas from each other.

10. The inductor of claim 8, wherein the coil patterns disposed inwardly have the same cross-sectional area as each other.

11. The inductor of claim 8, wherein the coil patterns disposed inwardly have different cross-sectional areas from each other.

12. The inductor of claim 8, wherein at least one of the coil patterns disposed inwardly has a line width greater than that of the coil patterns disposed in the outermost positions.

13. The inductor of claim 8, wherein a thickness of at least one of the coil patterns disposed inwardly is thicker than that of the coil patterns disposed in the outermost positions.

14. The inductor of claim 13, wherein a ratio (t1/t2) of the thickness t1 of the coil pattern thicker than the coil patterns disposed in the outermost positions among the coil patterns disposed inwardly to the thickness t2 of the coil patterns disposed in the outermost positions satisfies $1<(t1/t2)<12.6$.

15. The inductor of claim 13, wherein the coil patterns disposed inwardly have the same thickness as each other.

16. The inductor of claim 13, wherein the coil patterns disposed inwardly have different thicknesses from each other.

17. The inductor of claim 8, wherein the coil patterns disposed in the outermost positions have different thicknesses from each other.

18. The inductor of claim 8, wherein the plurality of coil patterns are stacked perpendicularly to a board mounting surface.

* * * * *